US011812803B2

(12) United States Patent
Iverson et al.

(10) Patent No.: US 11,812,803 B2
(45) Date of Patent: Nov. 14, 2023

(54) FACE SHIELD

(71) Applicant: MacNeil IP LLC, Bolingbrook, IL (US)

(72) Inventors: David S. Iverson, Oak Brook, IL (US); Larry Melcher, Allendale, MI (US)

(73) Assignee: MacNeil IP LLC, Bolingbrook, IL (US)

( * ) Notice: Subject to any disclaimer, the term of this patent is extended or adjusted under 35 U.S.C. 154(b) by 339 days.

(21) Appl. No.: 17/011,112

(22) Filed: Sep. 3, 2020

(65) Prior Publication Data

US 2022/0061422 A1 Mar. 3, 2022

(51) Int. Cl.
*A41D 13/11* (2006.01)

(52) U.S. Cl.
CPC ..... *A41D 13/1161* (2013.01)

(58) Field of Classification Search
CPC ..... A41D 13/11; A41D 13/1161; A41D 13/1184; A42B 3/225; A61F 9/06
See application file for complete search history.

(56) References Cited

U.S. PATENT DOCUMENTS 5,647,060 A * 7/1997 Lee ..... A61F 9/02 128/857
2021/0298381 A1* 9/2021 Yeaman ..... A41D 13/1184
2021/0345701 A1* 11/2021 Mamatas ..... A41F 1/008
2021/0386137 A1* 12/2021 Martino ..... A41D 13/1184
2021/0392970 A1* 12/2021 Basta ..... A41D 13/1161
2021/0392973 A1* 12/2021 Whitehead ..... A41D 13/1184
2022/0030976 A1* 2/2022 Harris ..... A41D 13/1161
2022/0061425 A1* 3/2022 Bailliet ..... A41D 31/30

OTHER PUBLICATIONS

Amazon, Salon World Safety Face Shields Ultra Clear Protective Full Face Shields, downloaded Jun. 7, 2021, https://www.amazon.com/Salon-World-Safety-Face-Shields/dp/B08B2KJHRP/ref=sr_1_4_sspa?dchild=1&keywords=face+shields&qid=1623086717&sr=8-4-spons&psc=1&spLa=ZW5jcnlwdGVkUXVhbGlmaWVyPUEyOFFGQkZMNkkwQU9SJmVuY3J5cHRlZElkPUEwMDAyNzc1Q1VMQTc5V05QVUdkJmVuY3J5cHRlZEFkSWQ9QTAzNTg5ODBJQTlNMFBGWVk0M1Qmd21kZ2V0TmFtZT1zcF9hdGYmYWN0aW9uPWNsaWNrUmVkaXJlY3QmZG9Ob3RMb2dDbGljaz10cnVl.

* cited by examiner

*Primary Examiner* — Aiying Zhao
(74) *Attorney, Agent, or Firm* — PERKINS IP LAW GROUP LLC; Jefferson Perkins

(57) ABSTRACT

A face shield comprises a frame that includes a headband, a visor support member and a standoff member spacing the headband from the visor support member. The headband has a strap portion that extends from a center thereof to a right end and to a left end, both positioned rearwardly of the center. A reinforcing rib of the headband outwardly extends from the strap portion but extends for only part of the distance toward the right and left ends of the strap portion. This leaves more elastic, distal portions of the strap portion which will flex more than the reinforced portion. A transparent visor downwardly depends from the visor support member and is removably fastened thereto.

9 Claims, 10 Drawing Sheets

FACE SHIELD

BACKGROUND OF THE INVENTION

Numerous apparatus are known that attempt to impose a barrier between the mucosal membranes of a person and airborne-spread infectious diseases, or to prevent the outward spread of such diseases from the wearer. One variety of these are face shields, which include a transparent visor that covers the entirety of a user's face, and one of various structures to attach this visor to the head of the user. One common expedient is to stand off the visor from the face of the user by a thick strip of Styrofoam, foam rubber or the like that wraps around a considerable portion of the user's forehead and temples. The attachment is completed by passing a simple ring around the entire head of the user. A second approach mounts the face shield on the user's nose, after the manner of eyeglasses.

Ideally, a face shield should be lightweight, comfortable, firmly secured to the head of the user but nonetheless easy to put on and take off, have a standoff that separates the user's face from the inner surface of the visor, have a means for defining the shape of the transparent visor itself, and be capable of having its transparent visor easily replaced.

SUMMARY OF THE INVENTION

A face shield according to the invention comprises a frame that has a headband, a visor support member and a standoff member spacing the headband from the visor support member. The headband, which is preferably molded from an elastic polymeric material, has a center for mounting adjacent the user's forehead, a right end and a left end. The right and left ends of the headband are disposed rearwardly of the center and in use are disposed adjacent a rear portion of the user's head. The headband includes a strap portion with a thickness that is less than its width. The strap portion extends from the center by a first length around the head of the user to the right end and extends from the center by a second length around the head of the user to the left end. A reinforcing rib is formed on the outer surface of the strap portion to extend outwardly therefrom. The reinforcing rib does not extend for the entire length of the strap portion but only for left and right reinforced portions thereof. The distal portions of the strap portion remain unreinforced, and therefore are more elastic or springy than the reinforced portions. The visor support member is disposed radially outwardly from the headband, is elongate and has a center. A transparent visor is removably fastened to the visor support member to downwardly depend therefrom, thereby protecting the eyes, nose and mouth of the user from certain airborne contaminants and impeding the emission of water droplets and the like outward from the user into the general environment.

In an embodiment, the right and left ends of the strap portion terminate in concave hooks that face away from the back of the user's head. In an embodiment, an elongate fastening strap is used to fasten these hooks together. The fastening strap may have a first hole which is slid onto a first one of the hooks, and a plurality of second holes, spaced from the first hole and each other, one of which is slid onto a second one of the hooks to complete the fastening of the face shield to the user.

In an embodiment, right and left sections of the reinforcing rib are joined to the standoff member, which has a length, in a front to rear horizontal direction, and a width, in a lateral horizontal direction orthogonal to the front to rear horizontal direction, which are much greater than its thickness in a vertical direction. The standoff member thus aids in the stiffening of the strap portion of the headband.

In an embodiment, a plurality of spaced-apart holes are formed near the upper margin of the visor. A plurality of barbs, formed to extend outwardly from an outer surface of the visor support member, are inserted into respective ones of these holes, to releasably attach the visor to the visor support member.

In one embodiment, a forehead cushion, which is molded of a thermoplastic polymeric material that is softer than the material used to mold the headband, is disposed on an inner surface of the strap portion. In an embodiment, the inner surface of the forehead cushion is divided by a plurality of channels into sub-areas, permitting the selective deformation of the sub-areas and enhancing user comfort.

In one embodiment, a width, in a vertical direction, of a central section of the strap portion of the headband is greater than the width of either a right or a left section thereof. The increase in width increases the surface area of contact to the user's forehead and therefore enhances comfort.

In an embodiment, the overall width in a horizontal lateral direction of the visor support member is greater than an overall width in the horizontal lateral direction of the headband. The overall width of the headband in turn is greater than an overall width in the horizontal lateral direction of the standoff member. The unreinforced portions of the headband strap portion, in an unflexed position or condition, are relatively close together. But, when the headband is fitted to the head of the user, the unreinforced portions of the strap portion will outwardly flex to assume one of a plurality of flexed positions. Within a predetermined range of these flexed positions, the convex curve defined by the visor support member is not deformed by the flexure of the unreinforced strap portions.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
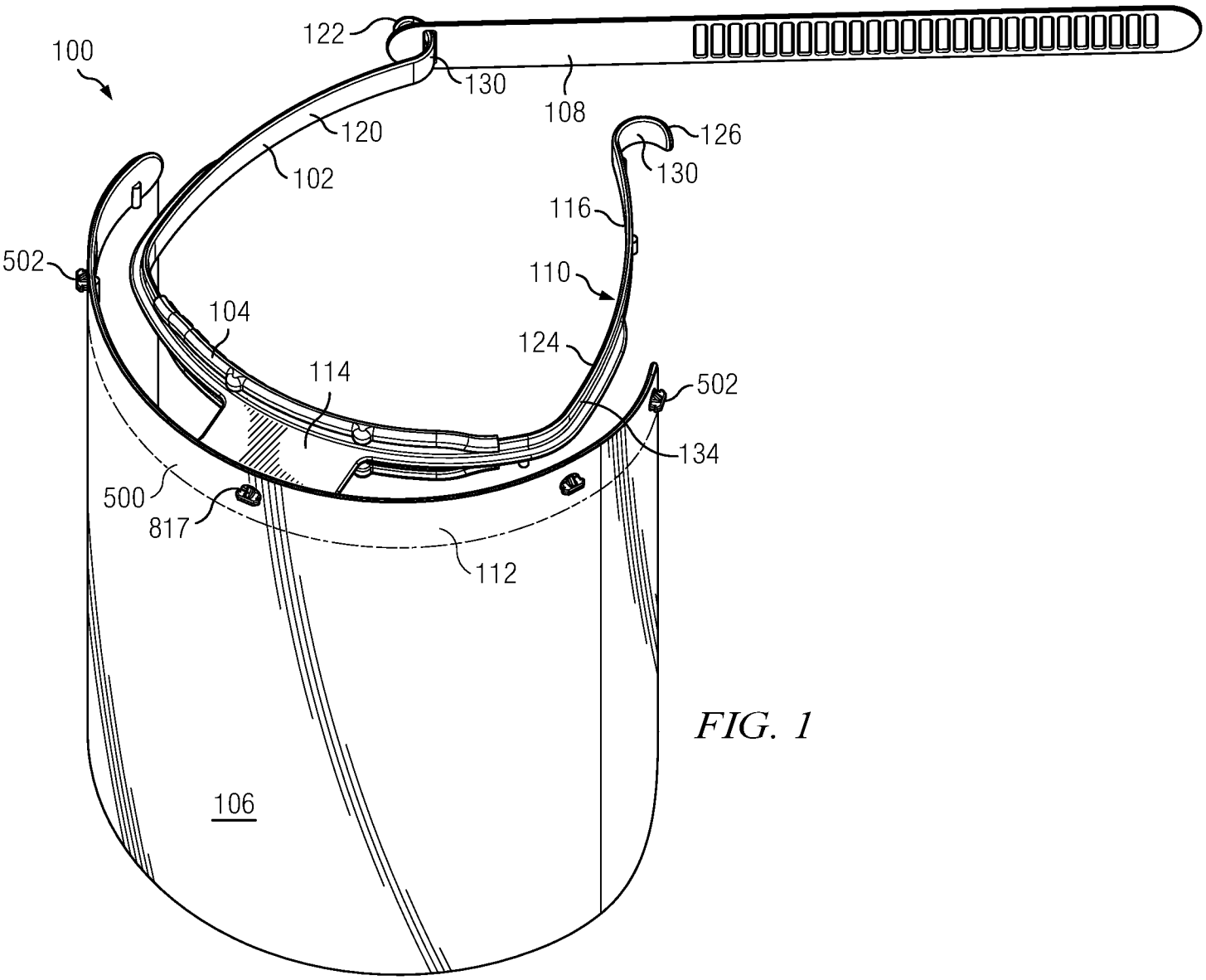
FIG. 1 is atop front perspective view of a face shield according to our invention.

A face shield according to an illustrated embodiment of the invention is generally shown at 100 in FIG. 1. The major components of face shield 100 are a frame 102, preferably injection-molded of an elastic polymer such as polypropylene or polyethylene; a forehead cushion 104, disposed at least on a rear surface of a headband strap portion as will be described in more detail below; a visor 106, preferably formed of a thin sheet of polycarbonate, biaxially-oriented polyethylene terephthalate (sold under the trademarks MYLAR®, MOLINEX® and HOSTAPHAN®) or other suitable clear and transparent polymeric material; and a fastening strap 108 that optionally is used to complete the fastening of the face shield 100 to the head of a user.

The frame 102 in turn has a headband 110, adapted to be worn around the head of a user, a visor support member 112 and a standoff member 114 that outwardly spaces the visor support member 112 from the headband 110. As seen in FIGS. 2-5, headband 110 includes an elongate strap portion 116 that has a depth, in a horizontal direction, that is much smaller than a width in the vertical direction. The strap portion 116 extends from a center 118 both to the right and to the left, around the user's head. A first length 120 of the strap portion 116 extends from center 118 to a right end 122. A second length 124 of the strap portion 116 extends from center 118 to a left end 126.

In one embodiment, the right end 122 of the strap portion terminates in an outward-facing, outwardly concave right hook 128, while the left end 126 terminates in an outward-facing, outwardly concave left hook 130 that faces away from hook 128. Hooks 128 and 130 may be used as attachment points for the fastening strap 108, in a manner later described.

The headband 110 also has a reinforcing rib 132 that extends radially outwardly from an outer surface 134 of the strap portion 116. A right section 136 of the reinforcing rib 132 has a near end 138 that is joined to, and preferably is integrally molded with, a right margin of the standoff member 114. The right section 136 extends rightwardly, then around right temporal corner 140 and then rearwardly, to a far end 142. The far end 142 is far short of right end 122 of the strap portion 116, leaving a right unreinforced portion 144 that extends from rib far end 142 to the strap portion right end 122.

Similarly, a left section 146 of the reinforcing rib 132 has a near end 148 that is joined to, and preferably is integrally molded with, a left margin of the standoff member 114. The left section extends from near end 148 leftwardly, around left temporal corner 150 and then rearwardly, terminating in a far end 152. The far end 152 is far short of left end 126 of the strap portion 116, leaving a left unreinforced portion 154 that extends from left rib section far end 152 to the left end 126 of strap portion 116. The unreinforced portions 144, 154 will be more elastic or "springy" than the reinforced strap portions created by rib 132. As a result, they will compressably hug the back of the user's head to a greater extent than the rest of the headband 110.

In the illustrated embodiment, a thickness in a vertical direction of the reinforcing rib 132 is the same as a thickness in the vertical direction of standoff member 114. In the illustrated embodiment, the standoff member 114 acts as a portion of reinforcing rib 132, in that it resists any deformation in a horizontal direction of that portion of strap portion 116 that it adjoins. The vertical direction is shown at 508 in FIG. 5A.

Figure 2:
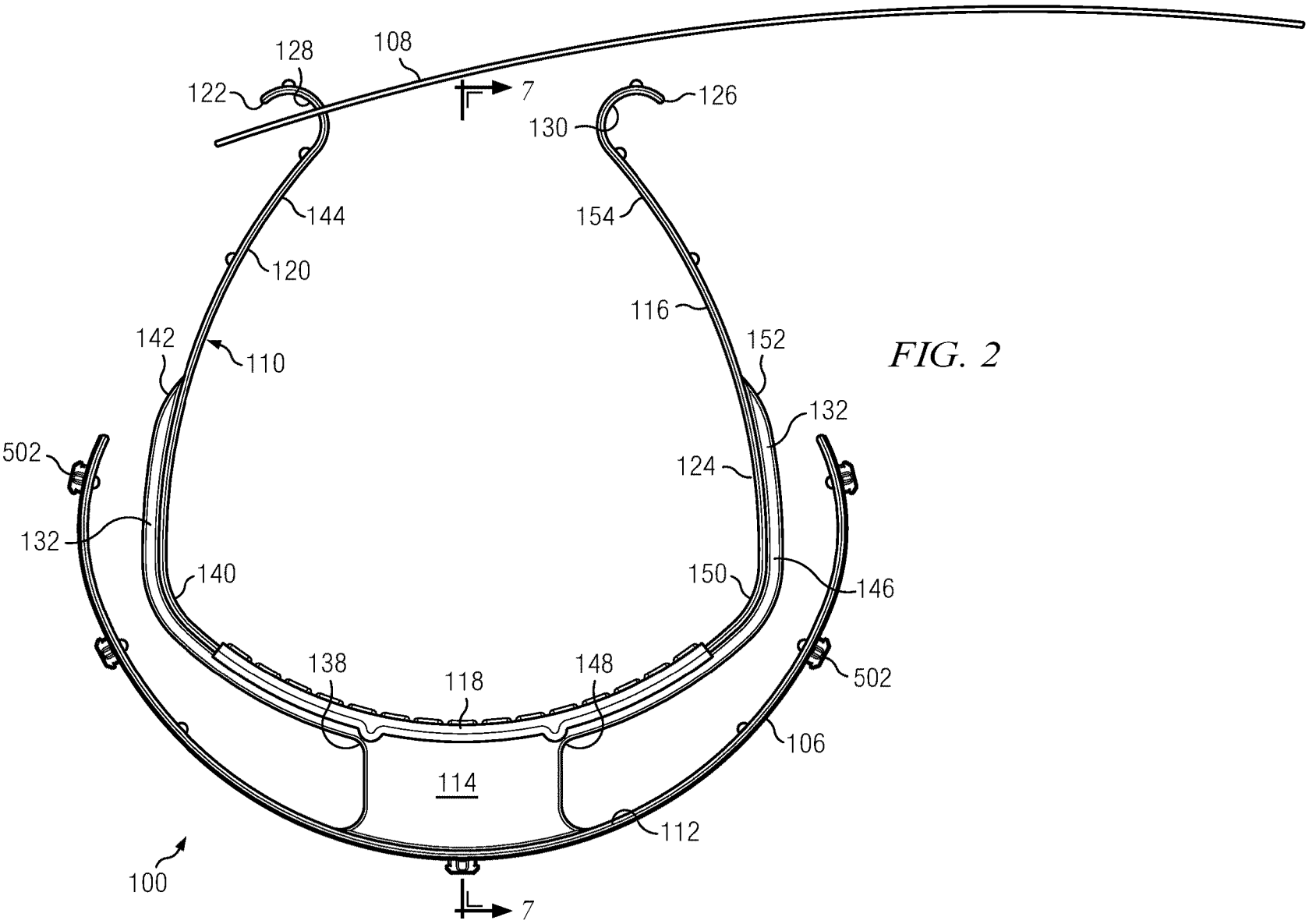
FIG. 2 is a top view of the face shield shown in FIG. 1, with unreinforced portions of the strap portion of the headband shown in an unflexed position.
Figure 3:
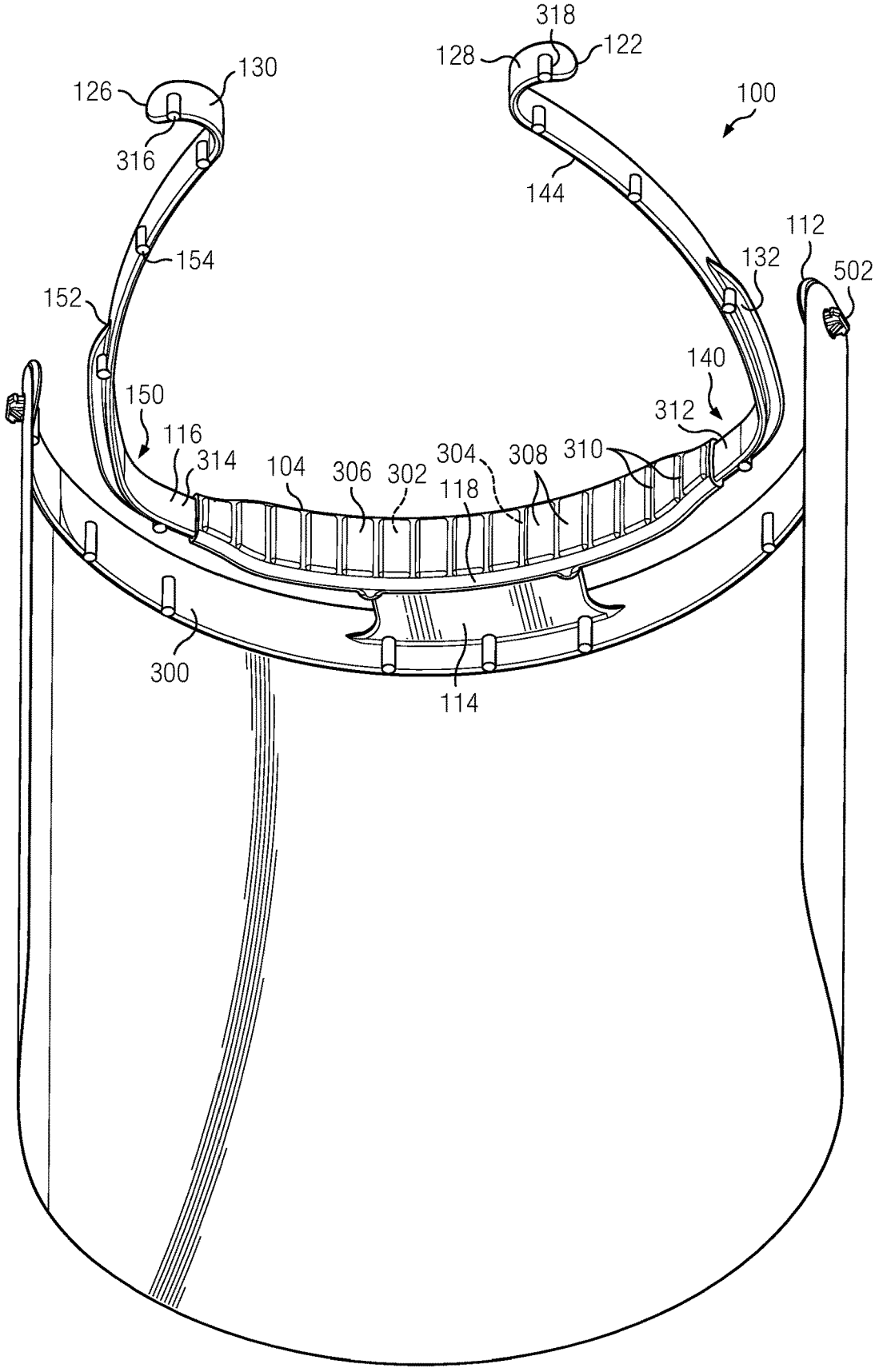
FIG. 3 is a bottom rear perspective view of the face shield shown in FIG. 1.

The standoff support member 114 extends from the outer surface 134 of the headband strap portion 116 (FIG. 4) to an inner surface 300 of visor support member 112 (FIG. 3). In general, the visor support member 112 conforms to an arc that is outward of, and partially forward of, the position of the headband strap portion 116 (FIG. 2). The spacing between strap portion 116 and visor support member 112 can be in the range of about 1 to about 4 cm, and in one embodiment is about 3.1 cm. Since the visor 106 will take on a cylindrical shape whose cross section is the same as the shape of the outer surface 500 of the visor support member 112 (FIG. 4), the spacing afforded by standoff member 114 affords critical relief to the nose, mouth and face of the user.

Figure 4:
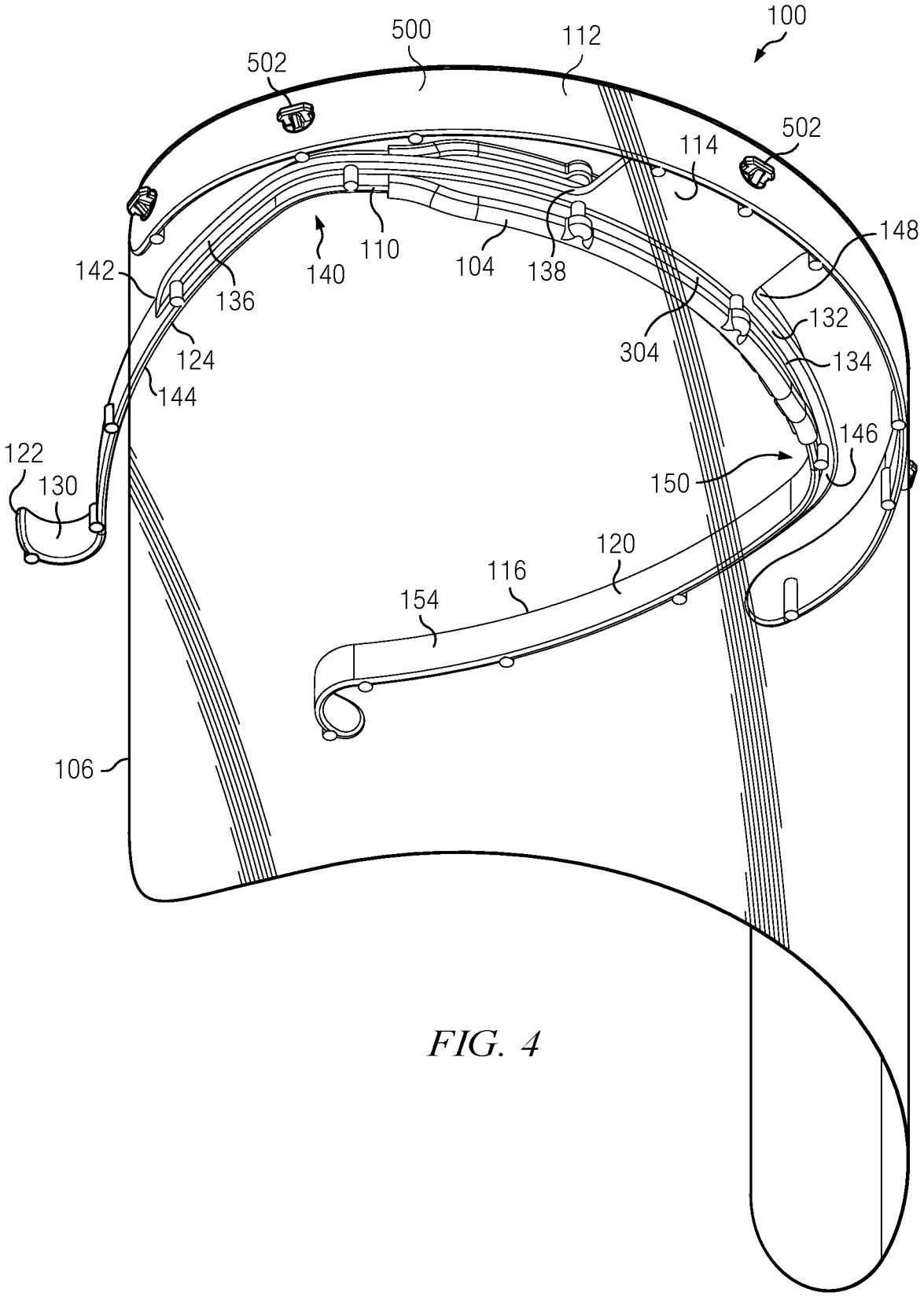
FIG. 4 is a bottom front perspective detail of the face shield shown in FIG. 1.

The visor support member 112 is wider in a vertical direction than it is thick in a horizontal direction, so as to lend stability to the position of the attached visor 106. As assembled to the visor support member 112, the visor 106 is supported by and downwardly depends from the visor support member 112. The visor 106 is removably affixed to the visor support member 112. In the illustrated embodiment, this is accomplished by providing a plurality of spaced-apart barbs 502 that preferably are integrally molded with, and outwardly extend from, the outer surface 500 of the visor support member 112 (FIG. 4).

Figure 8:
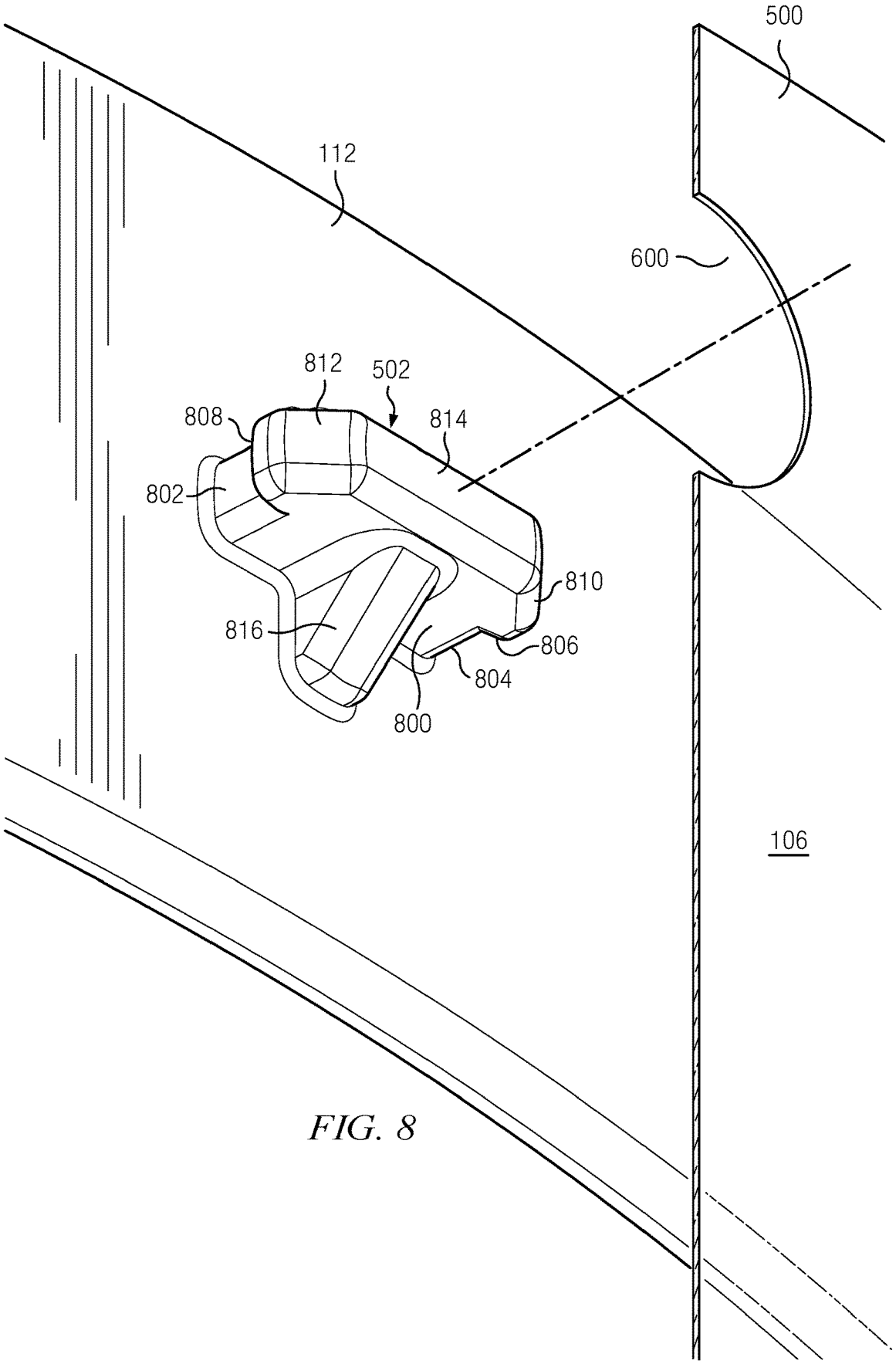
FIG. 8 is a detail of one of the barbs used as a visor fastener in a preferred embodiment of the invention, a visor shown in exploded relation and in section.
Figure 9:
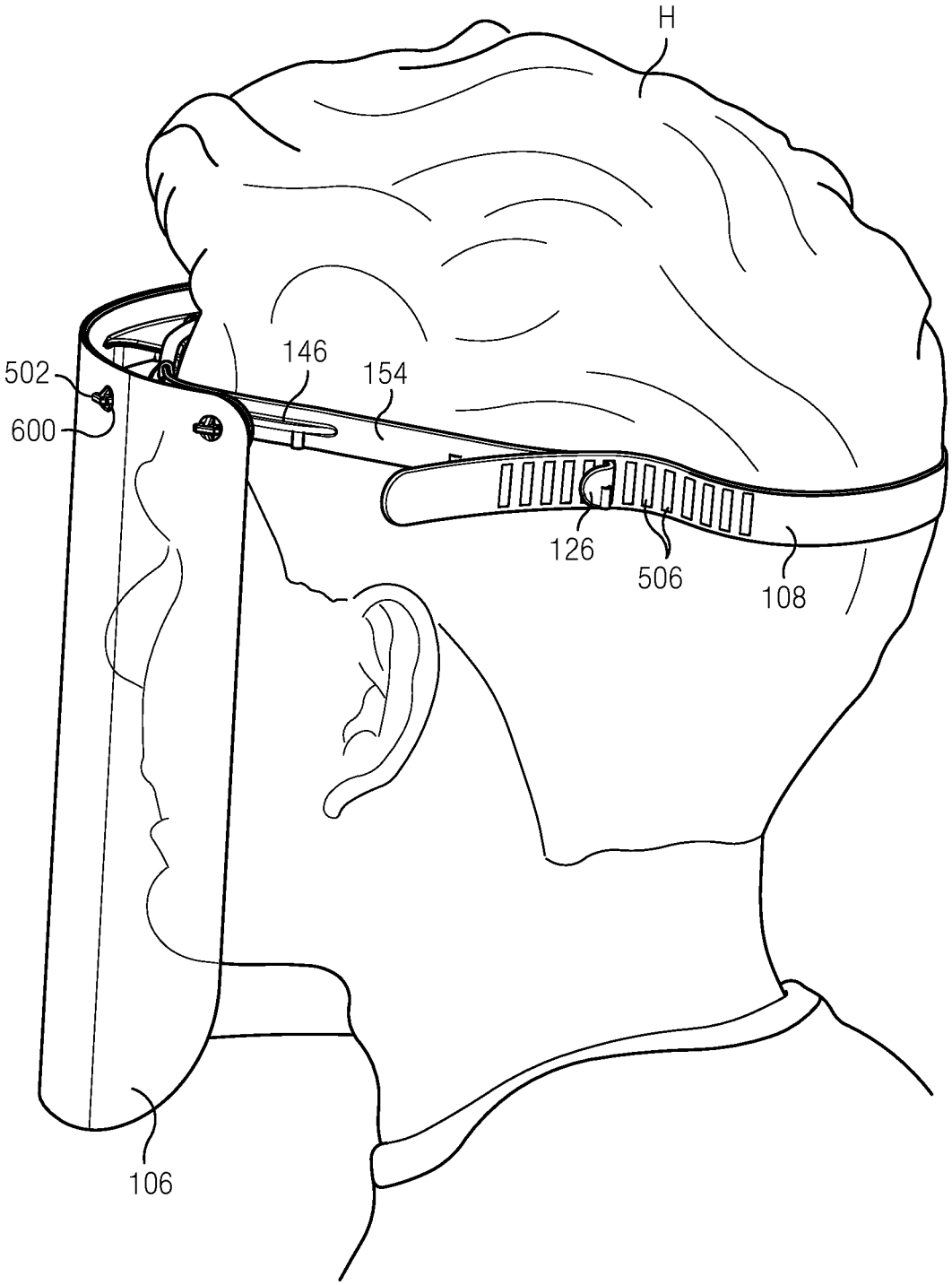
FIG. 9 is a rear side perspective view of the face shield as being worn by a user.

A detail of a representative one of the barbs 502 is seen in FIG. 8. A wall 800 of the barb 502 outwardly extends from outer surface 500 of the visor support member 112. A right side 802 and a left side 804 of the wall 800 are straight for a good portion of the length in a radial direction of the wall 800. The left side then forms a laterally and leftwardly extending vertical surface 806 while the right side forms a laterally and rightwardly extending vertical surface 808. The vertical surfaces of barb 502 are finished by outwardly extending, rightgoing beveled surface 810, outwardly extending, leftgoing beveled surface 812, and a flat end surface 814 in between surfaces 810 and 812. The wall 800 is supported at its vertical center by a triangular bottom gusset 816, and by a triangular top gusset 817 (FIGS. 1 and 6) similar in shape to bottom gusset 816. The top and bottom gussets 817, 816 of barb 502 aid in the centering and registration of the visor attachment holes (described below) on respective barbs 502. The vertical surfaces 806, 808 prevent the inadvertent detachment of the visor 106 from the visor support member 112, while the opposed beveled surfaces 810, 812 aid in the registration of the visor attachment holes with respective barbs 502.

Figure 6:
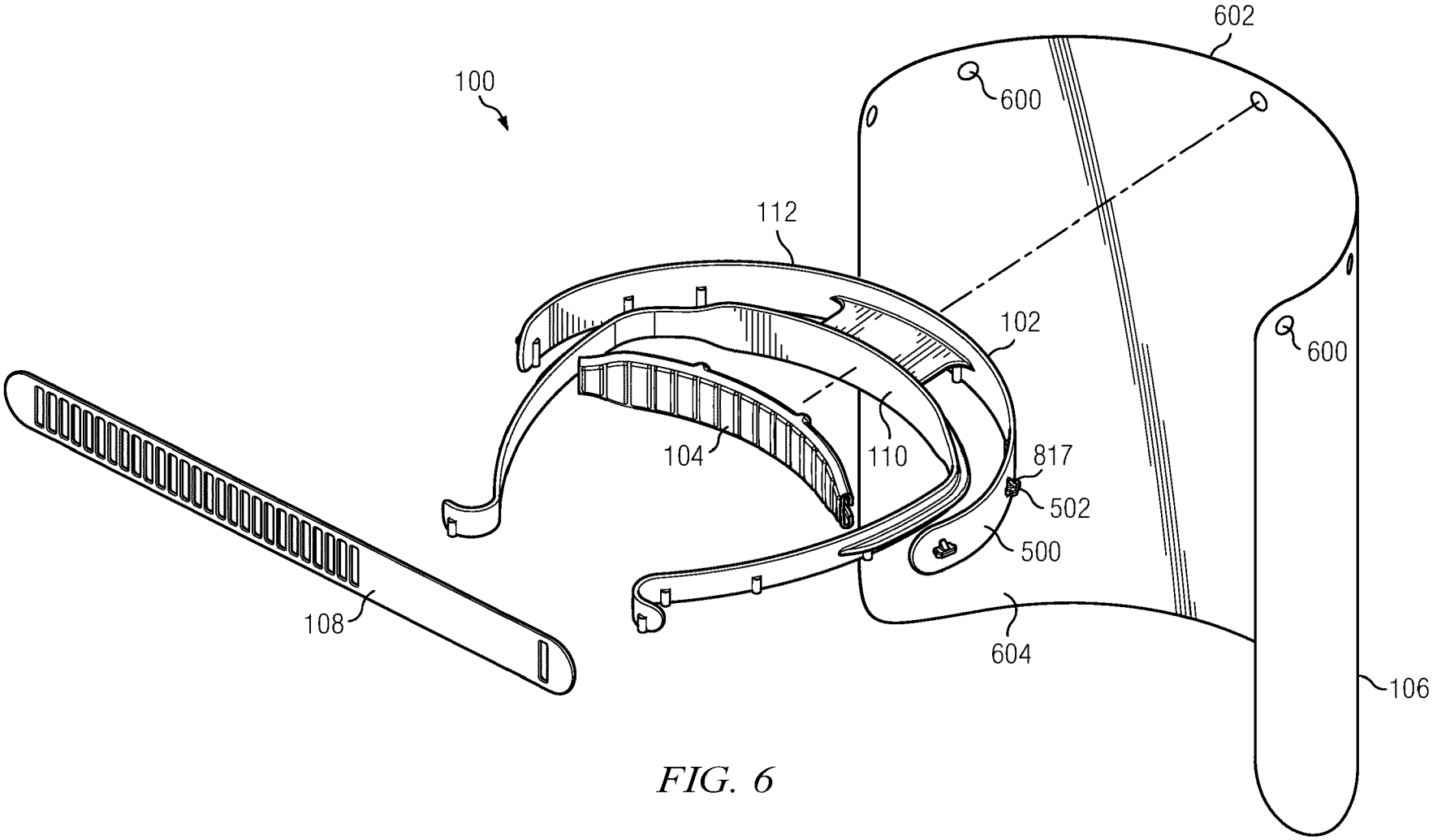
FIG. 6 is an exploded top rear perspective view of the face shield shown in FIG. 1.

As best seen in the exploded view shown in FIG. 6, the visor 106 has a plurality of circular holes 600 formed through it near its top margin 602. Each such hole 600 is snapped onto a barb 502, such that a rear surface 604 of the visor 106 is positioned to be adjacent to the front or outer surface 500 of the support member 112. The visor 106 is made of a transparent plastic sheet that is considerably thinner than the length of the straight sections of barb wall sides 802, 804, for ease in attaching and detaching the visor from the support member 112. This permits the visor 106 to be easily removed for cleaning or replacement if the visor 106 becomes scratched.

Figure 7:
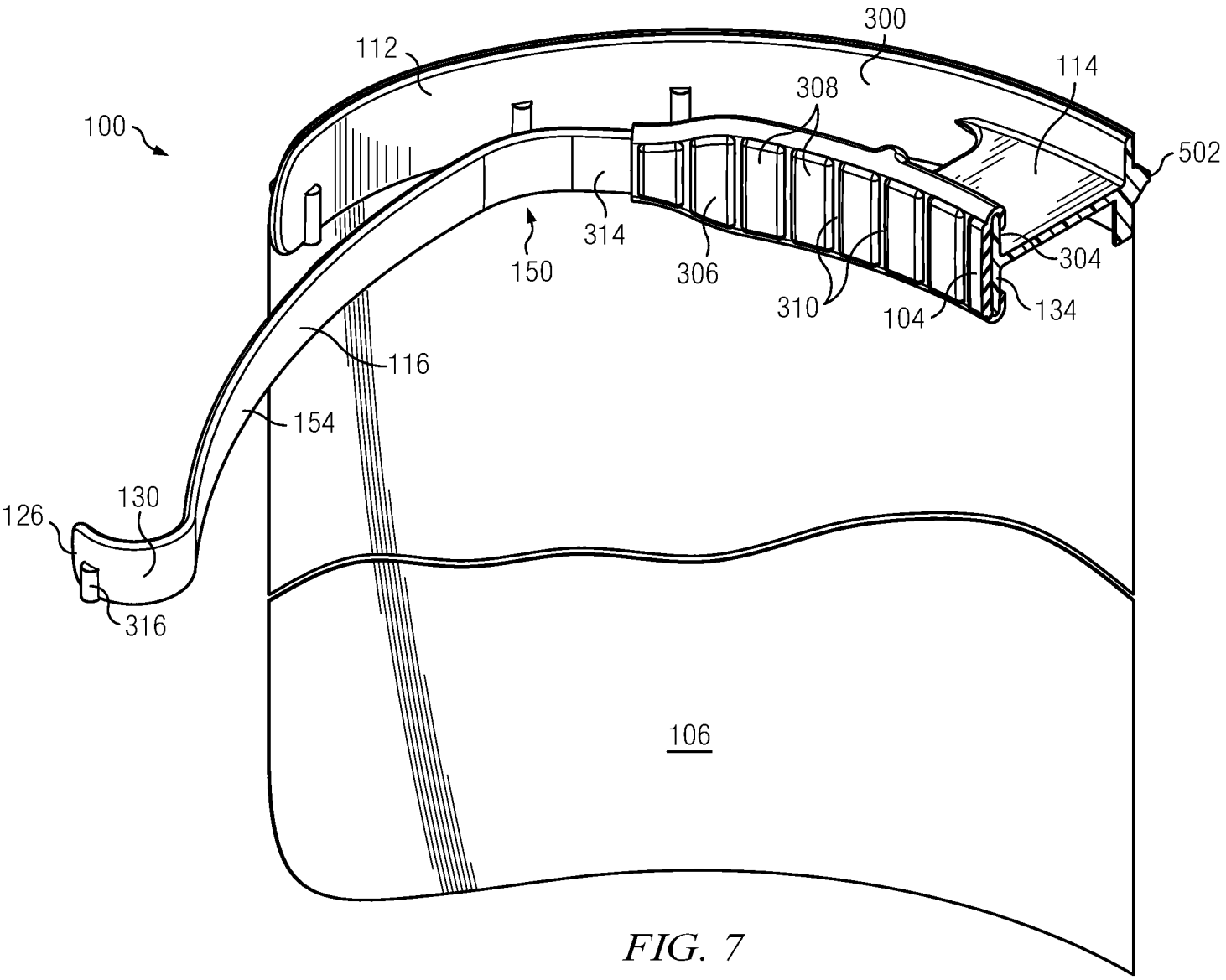
FIG. 7 is a part-perspective, part-sectional view taken along Line 7-7 of FIG. 2.

The forehead cushion 104 (FIG. 6) should be formed of a thermoplastic polymer compound which as molded will be softer than the polymer used to mold strap portion 116. As well seen in FIGS. 3, 4 and 7, the forehead cushion completely covers the inner surface 302 of a central section 304 of the strap portion 116, and wraps around strap portion 116 to cover top and bottom portions of the outer surface 134 of the strap portion 116, within this same central section. This mechanically locks the forehead cushion 104 onto the strap portion 116. In the illustrated embodiment and as seen in FIGS. 3 and 7, an inner surface 306 of the forehead cushion 104, which in use is pressed against the forehead of the user, is divided up into rectangular sub-areas 308 by a plurality of spaced-apart, vertically disposed channels 310. When some or most of the sub-areas 308 are pressed against the user's forehead, they have the ability to expand sideways into the channels 310, thereby better distributing pressure over a large area of the forehead. Also to this end, the central section 304 of the strap section has a width in a vertical direction that is greater than a width of a right section 312 of the strap portion 116, and also is greater than a width of an adjacent left section 314 of the strap portion 116.

Figures 5, 5A:
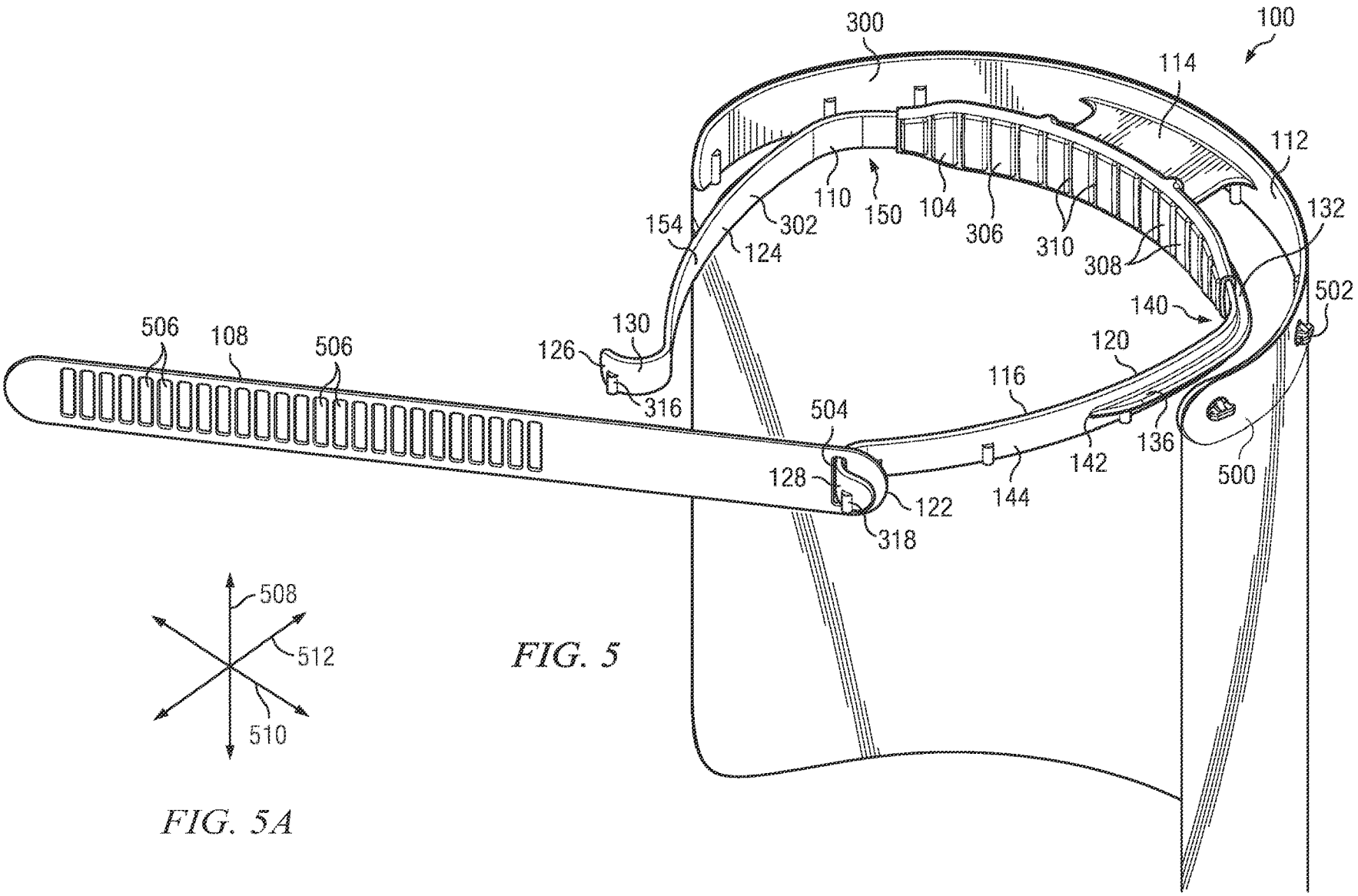
FIG. 5 is a top rear perspective view of the face shield shown in FIG. 1.
FIG. 5A is a frame of reference oriented to the view shown in FIG. 5.

The fastening strap 108 optionally may be used to even more firmly secure the face shield 100 to the head of the user. As seen in FIG. 5, strap 108 is elongate and has a first slot or hole 504 that may be slipped over right end 122 and onto right hook 128. Strap 108 further includes a series of second holes 506 that are spaced apart from hole 504 and from each other. Left strap portion end 126 is inserted into a selected one of the holes 506 to complete the securement. Alternatively, the first strap hole 504 can be slid onto left end 126, and a selected one of the second strap holes may be slid onto the right end 122.

While headband strap portion 116 has a shape that is mostly thin and wide, as molded it will have a plurality of cylinders along is length that are artifacts of knock-out pins of the injection mold tooling. Two of these are a cylinder 316 near end 126, and a cylinder 318 near strap end 122. Cylinders 316, 318 act as impediments to fastening strap 108 inadvertently slipping off of hooks 128, 130.

Figure 10:
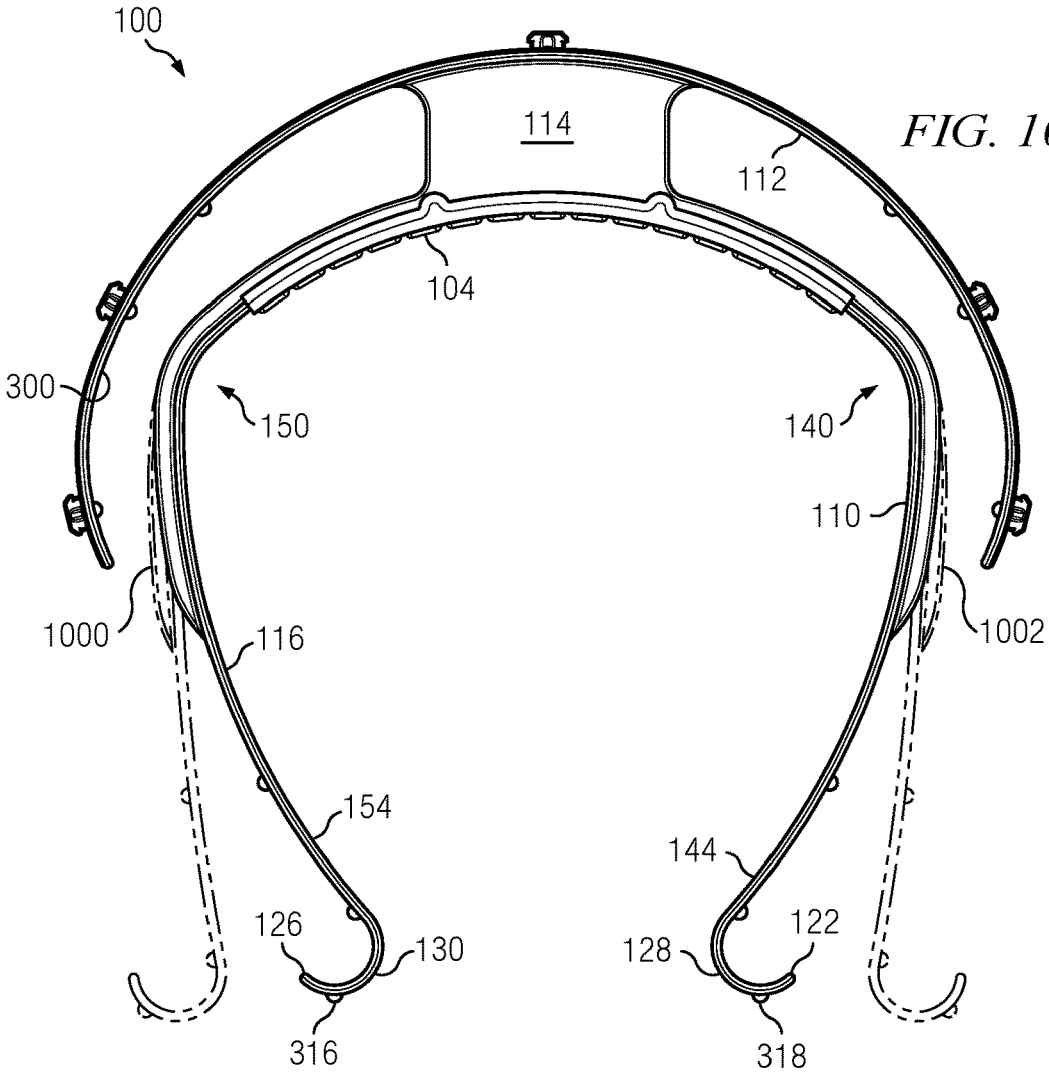
FIG. 10 is a top view corresponding to FIG. 2 but showing the strap portion of the headband in a flexed position in phantom.
Figure 11:
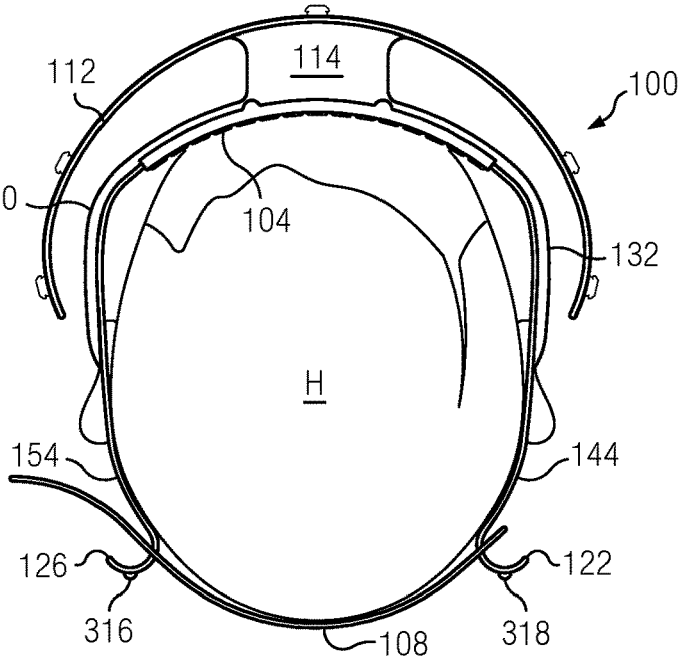
FIG. 11 is a top view of the face shield as worn by a user, showing flexure of unreinforced sections of the headband strap portion as a result of the headband conforming to the head of the user.

FIG. 10 is a top view of a face shield 100 as shown in an unflexed condition (solid lines) and in a flexed condition (phantom lines). FIG. 11 is a top view of a face shield 100 installed on a head H of a user. As can be seen, the ends 122, 126 are outwardly flexed by a great extent from their unflexed condition and grip the rear of the user's head. The strap 108 is bowed rearwardly from its points of attachment 128, 130 to strap portion 116. The ends 122, 126 are capable of assuming any of a number of flexed positions, as the heads of different users might dictate, only one of which is shown in FIG. 10. Within a predetermined range of such flexed positions, the flexure of the unreinforced strap portions 144 and 154 will not deform the shape of the visor support member 112, which will remain in a predetermined convex curve. This is because, in the illustrated embodiment, an overall width in a lateral horizontal direction of standoff member 114 is much less than an overall width in this direction of headband 110, and the overall width of headband 110 in turn is less than the width of visor support member 112. The lateral horizontal direction is shown at 510 in FIG. 5A. FIG. 5A also shows the front-to-rear horizontal direction 512. This permits unreinforced strap portions 144 and 154 to outwardly flex within a large, predetermined range, the outermost extent of which is defined by points 1000, 1002 of rib 132 abutting the inner surface 300 of visor support member 112. Meanwhile the portions of headband 110 that are reinforced by rib 132 and standoff member 114 flex only slightly (as shown in the illustrated embodiment), or not at all (in an alternative embodiment).

In summary, a face shield has been illustrated and described that includes reinforced and nonreinforced strap portions of a headband, which portions will therefore differentially flex when the headband is placed on the head of a user. While illustrated embodiments of the present invention have been described and illustrated in the appended drawings, the present invention is not limited thereto but only by the scope and spirit of the appended claims.

We claim:

1. A face shield comprising:

a frame including a headband, a visor support member and a standoff member spacing the headband from the visor support member;

the headband including an elongate strap portion adapted to be fitted around a head of a user, the visor support member, the standoff member and the strap portion being integrally molded of an elastic polymeric material, the strap portion having a right end, a center adapted to be positioned adjacent a forehead of the user, and a left end opposed to the right end, the right and left ends disposed rearwardly of the center and in use disposed adjacent a rear portion of the user's head;

the strap portion having an outer surface which in use faces away from the head of the user and an opposed inner surface which in use faces toward the head of the user, the strap portion having a thickness from the inner surface of the strap portion to the outer surface of the strap portion and a width in a vertical direction, the width being greater than the thickness, the strap portion extending from the center of the strap portion to the right end of the strap portion by a first length and extending from the center of the strap portion to the left end of the strap portion by a second length;

a reinforcing rib of the headband integrally formed on the outer surface of the strap portion of the headband to outwardly extend therefrom, the reinforcing rib extending rightward from the center of the strap portion for a reinforced portion of the first length and extending leftward from the center of the strap portion for a reinforced portion of the second length, a remainder of the first length of the strap portion constituting a right unreinforced portion of the strap portion, a remainder of the second length of the strap portion constituting a left unreinforced portion of the strap portion, the left and right unreinforced portions of the strap portion being more elastic than the reinforced portions of the strap portion, the left and right unreinforced portions of the strap portion adapted to compressibly hug the back of the head of the user to a greater extent than a remainder of the headband;

the visor support member disposed radially outwardly from the headband, being elongate and having a center, the visor support member having an inner surface adapted to face the head of the user and an outer surface adapted to face away from the head of the user, a thickness of the visor support member measured from the inner suffice of the visor support member to the outer surface of the visor support member, a width of the visor support member in the vertical direction being greater than the thickness of the visor support member;

the standoff member extending from the outer surface of the strap portion at the center of the strap portion to the inner surface of the visor support member at the center of the visor support member, the standoff member having a thickness in the vertical direction, a length in a front to rear horizontal direction orthogonal to the vertical direction, and a width in a lateral horizontal direction orthogonal to the vertical direction and to the front to rear horizontal direction, the width of the standoff member and the length of the standoff member each being greater than the thickness of the standoff member, the width of the standoff member extending from a left margin of the standoff member to a right margin of the standoff member, a right section of the reinforcing rib joined to the right margin of the standoff member and a left section of the reinforcing rib joined to the left margin of the standoff member such that the standoff member is continuous with and acts as a portion of the reinforcing rib; and a transparent visor downwardly depending from the visor support member, the transparent visor removably fastened to the visor support member.

2. The face shield of claim 1, wherein the right end of the strap portion terminates in a concavely curved right hook and the left end of the strap portion terminates in a concavely curved left hook.

3. The face shield of claim 2, further comprising an elongate fastening strap having a first hole and a plurality of second holes each spaced from the first hole and from each other, the first hole adapted to be slid onto a first one of the left and right hooks, a selected one of the second holes adapted to be slid onto a second one of the left and right hooks so as to firmly secure the frame to the head of the user.

4. The face shield of claim 1, wherein the visor support member is formed as a convex curve in a horizontal plane, the visor being flexible, a curved shape of the visor defined by the convex curve of the visor support member.

5. The face shield of claim 4, wherein the headband has a headband width in the lateral horizontal direction and the visor support member has a visor support member width in the lateral horizontal direction, the visor support member width being greater than the headband width and the headband width being greater than the standoff member width;

the left and right unreinforced portions of the strap portion having an unflexed position in which the left and right ends are at a first distance from each other and a plurality of flexed positions in which the left and right ends are further apart from each other than the first distance, the left and right unreinforced portions assuming one of the flexed positions when the headband is placed around the user's head, flexing of the unreinforced portions throughout a predetermined flexing range causing no deformation of the convex curve of the visor support member.

6. The face shield of claim 1, wherein the visor has an upper margin and a lower margin opposed to the upper margin, a plurality of spaced-apart holes formed through the visor to be closer to the upper margin than the lower margin, a plurality of spaced-apart barbs formed to outwardly extend from the outer surface of the visor support member, the visor removably fastened to the visor support member by inserting the barbs through respective ones of the holes.

7. The face shield of claim 1, wherein the elastic polymeric material is a first thermoplastic polymeric material which has a first hardness, the headband further including a forehead cushion formed of a second thermoplastic polymeric material having a second hardness that is less than the first hardness.

8. The face shield of claim 7, wherein the forehead cushion has an inner surface for contact with the forehead of the user, the inner surface of the forehead cushion divided into a plurality of sub-areas spaced by channels so as to allow selective compressive deformation of the sub-areas on the forehead of the user and enhance comfort.

9. The face shield of claim 1, wherein the strap portion of the headband has a central section extending both rightward and leftward from the center of the strap portion, a right section of the strap portion extending from the central section of the strap portion to the right end, and a left section of the strap portion extending from the central section to the left end, a width of the central section of the strap portion in the vertical direction being greater than a width in the vertical direction of the right section of the strap portion and a width in the vertical direction of the left section of the strap portion.

* * * * *